United States Patent [19]

Kodman

[11] Patent Number: 4,518,094

[45] Date of Patent: May 21, 1985

[54] REMOVABLE LID AND POUR SPOUT

[76] Inventor: Ronald W. Kodman, 467 N. Van Ness Ave., Fresno, Calif. 93710

[21] Appl. No.: 285,598

[22] Filed: Jul. 21, 1981

[51] Int. Cl.[3] ..... B65D 51/18

[52] U.S. Cl. ..... 220/254; 220/307

[58] Field of Search ..... 220/254, 307, 380; 206/508, 509

[56] References Cited

U.S. PATENT DOCUMENTS 3,372,832 3/1968 Yeater et al. ..... 220/254

4,184,604 1/1980 Amberg et al. ..... 220/380 X 4,334,631 6/1982 Ballester ..... 220/307 X

*Primary Examiner*—George T. Hall

*Attorney, Agent, or Firm*—Victor Sepulveda

[57] ABSTRACT

A removeable closure of a flexible material for a cylindrical container having a pour spout and a plug therefor with a channel disposed around the peripheral edge to allow the diameter of the closure to vary. A pair of upwardly extending height-equalizing posts on the surface of the closure allow even stacking of containers.

2 Claims, 4 Drawing Figures

REMOVABLE LID AND POUR SPOUT

BACKGROUND OF THE INVENTION

This invention relates to a container replacement lid and more particularly to a novel and improved replacement lid having a pour spout with a closure therefor which is adaptable to fit containers of varying diameters.

Heretofore, many replaceable lids have been made to replace the lids originally accompanying containers. One prime example is the lids for paint cans. The prior art is replete with such lids and pour spouts for paint cans. Most paint cans come equipped with a lid which is attached to the top of the can wherein grooves and molding crevices in the can and lid intermesh when pressed together to hermetically seal the contents within the can.

However, when a portion of the contents of the can is poured into a second container, such as a spray paint container, some of the paint remains in the grooves and ridges of the can. Now when the original lid is replaced on the can and the grooves and ridges of this lid intermesh or engage with the paint-filled grooves and ridges in the can, the excess paint will squirt outwardly and run over the side of the can as well as on to the surrounding area and objects, resulting in the can becoming messy and difficult to handle.

The present invention provides for a replacement paint can closure which replaces the original lid once the can has been initially opened. Further, the present invention includes construction whereby it is adaptable to expand in diameter so as to fit cans of varying diameters. Too, as shown in one embodiment, the present invention may include support posts on the top of the closure so as to allow cans including the closure to be stacked on one another for storage.

SUMMARY OF THE INVENTION

Briefly described, the present invention includes a container closure such as a replacement for the lid of a paint can which comprises a discal shaped member having a downwardly depending skirt extending around the entire periphery of the lid. The lid may be comprised of a flexible material whereby the downwardly depending skirt is snapped into a corresponding groove in the paint can for releaseable engagement therewith. The lid includes a pour spout therein near the peripheral edge thereof for removal of the contents from the paint can and a plug hinged to the top of the lid and which is adapted to close the pour spout when not in use.

To facilitate the use of a single size lid on a paint can of varying sizes, a relieved portion in the form of a raised bead is disposed in the lid and is annularly shaped near the circumferential edge of the lid. This allows the lid to expand in diameter to accommodate different size cans.

In order that the cans may be stacked upon each other for storage, a pair of height-equalizing posts are disposed on the top of the lid and extend upwardly at a height substantially equal to the height of the pour spout and plug. This assures that the cans will rest evenly upon each other when stacked for storage. The lid of the present invention is a practical aid for replacement when the original paint can lid is removed.

DESCRIPTION OF THE DRAWINGS

These and other features and advantages will become more apparent to those skilled in the art when taken into consideration with the following detailed description wherein like references indicate like or corresponding parts throughout the several views and wherein.

DESCRIPTION OF THE SHOWN EMBODIMENT

Figure 1:
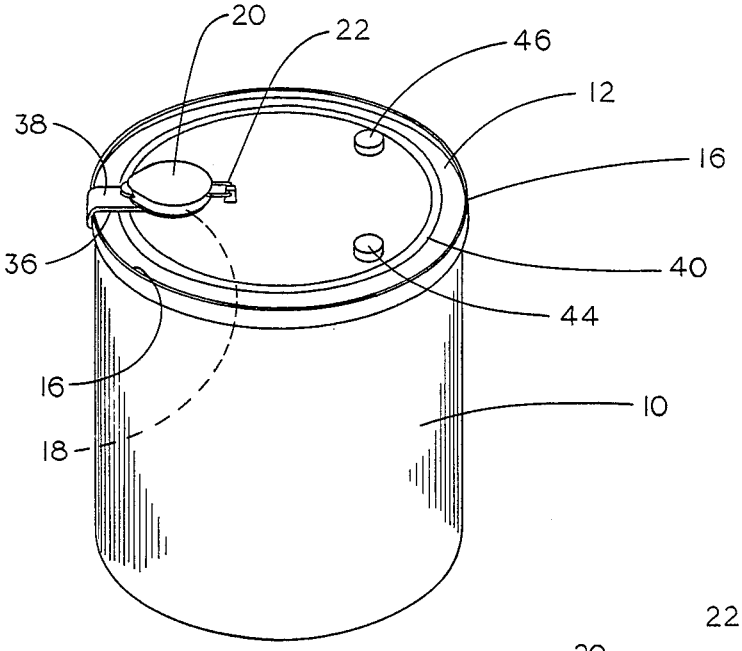
FIG. 1 is a perspective view of a paint can having a paint can lid of the present invention placed over the can opening.
Figure 2:
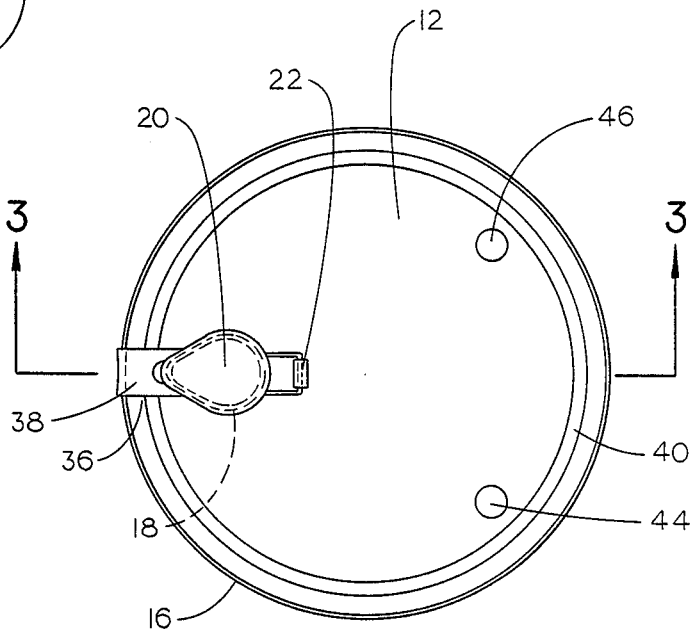
FIG. 2 is a top view of the paint can lid of FIG. 1.

Turning now to FIG. 1 of the drawings, the numeral 10 generally indicates a paint can having the replaceable lid 12 of the present invention. Generally the lid 12 may be comprised of a flexible material such as plastic which is adapted to fit over the can 12.

An opening 14 is placed in the lid 12 located near a peripheral edge 15 of the lid 12. The lid at the opening has an upstanding lip 16 around the entire circumference of the lid 12 to lend rigidity to the construction thereof. Also, an upstanding lip 18 extending around the opening 14 is the lid 12.

A plug 20 is hinged by hinge 22 to the top of the lid 12 and is constructed and formed to fit over the upstanding lip 18 to substantially seal the opening 14 when placed thereover. The plug 20 essentially seals the opening 14 so as the lid 12 is placed over the paint can 12 as hereinafter described, and the can 10 can be tipped over and the contents thereof will not spill therefrom.

Figure 4:
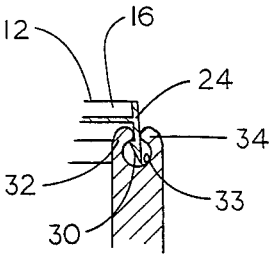
FIG. 4 is a partial section view showing the lid fitted into the grooves of the paint can.
Figure 3:
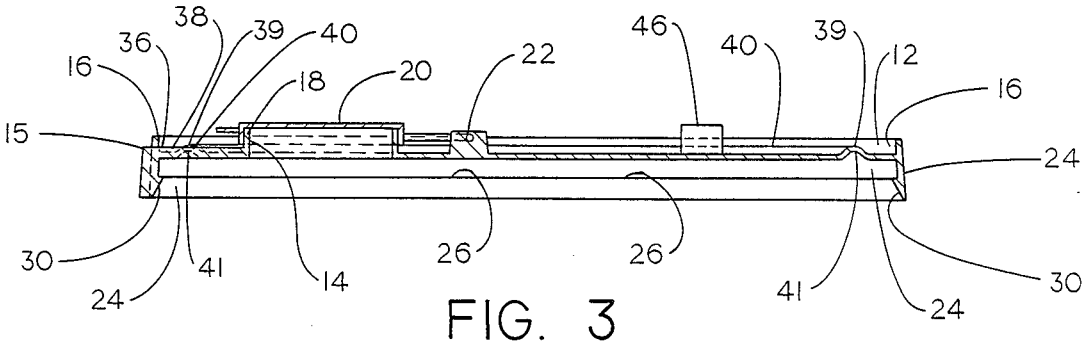
FIG. 3 is a section view taken along lines 3—3 of FIG. 1.

To facilitate hermetically sealing the lid 12 to the can 10, a downwardly depending lip 24 extends downwardly from the lid 12 completely around the can lid 12 and includes an inner ledge 26. The inner surface of the lip 24 is beveled at 30. Thus, as the beveled edge 30 of the lip 24 is forced between edges 32 and 34 in the groove 33 in the paint can as shown in FIG. 4, the ledge 26 engages the groove 33, for example, and seals the lid 12 thereto.

Because the area 36 where the opening 14 is placed may become weakened, a reinforcing strip 38 is placed in this area to prevent breakage or splitting of the lid material in this area.

In some cases, paint cans may have slightly different diameters due to different can manufacturers not having a standard tolerance. A raised area 40 is placed along the perimeter and slightly inside the circumferential edge of the lid so that the lid 12, being comprised of a flexible material, will be allowed to expand. This raised area 40 is formed as an upper bead 39 and inner groove 41 right in the material, allowing a stretching effect.

Because of the fact that cans are normally stacked on top of each other during storage, a pair of upstanding posts 44 and 46 are placed on the top of the lid 12 and equally spaced from each other and the plug 20. The posts 44 and 46 have a height substantially equal to the height of plug 20 so that the bottom of a corresponding can can be stacked evenly on the lid 12.

Having thus described but one shown embodiment of the present invention, what is claimed is:

1. A removable closure member for use in closing the opening of a cylindrical container, said member being comprised of a plastic pliable material, said container including a peripheral ridge with an annular tubular shaped receiving groove for receiving the closure member, said groove having an annular opening being reduced in size in relation to the size of the tubular shaped groove, said removable closure member including:

a substantially flat discal shaped portion having an outer peripheral edge, said portion having a circumferential size approximately equal to the circumferential size of said container and adapted to be placed over said container;

an opening in said discal shaped portion being disposed the peripheral edge of said discal shaped portion;

a downwardly extending sealing skirt disposed around the outer peripheral edge of said discal shaped portion adapted to be inserted into the opening in said tubular receiving groove of the container;

an inner annular lip disposed on the inner side of said downwardly extending skirt defining an annular groove between said lip and the under portion of said flat discal portion to effect sealing of said skirt in said receiving groove in said cylindrical container;

a beveled portion on said inner side of said skirt below said lip to reduce the size of said skirt to accommodate entrance of said skirt into the reduced opening in the groove in the container; and means disposed in said substantially flat discal shaped portion for causing the overall diameter of said member to increase in size when stretched on a container of enlarged diameter, said means including an annular channel formed in said flat discal shaped portion and spaced inwardly from the outer peripheral edge of said discal shaped portion.

2. The removable closure member as defined in claim 1 and further including:

a closure cap adapted to be removably secured over the opening in said discal shaped portion, and protruding above the top of said discal shaped portion; and at least two upwardly extending posts disposed on the top of said discal shaped portion evenly spaced from each other and said closure cap for allowing other cylindrical containers to be evenly stacked thereon.

* * * * *